US007941988B2

(12) United States Patent
Mars

(10) Patent No.: US 7,941,988 B2
(45) Date of Patent: May 17, 2011

(54) TILE SYSTEM AND METHOD

(76) Inventor: Montgomery Mars, San Clemente, CA (US)

( * ) Notice: Subject to any disclaimer, the term of this patent is extended or adjusted under 35 U.S.C. 154(b) by 0 days.

(21) Appl. No.: 12/779,581

(22) Filed: May 13, 2010

(65) Prior Publication Data

US 2010/0218358 A1 Sep. 2, 2010

Related U.S. Application Data

(63) Continuation of application No. 11/364,661, filed on Feb. 27, 2006, now Pat. No. 7,743,568.

(60) Provisional application No. 60/656,651, filed on Feb. 25, 2005.

(51) Int. Cl.
*E04F 13/08* (2006.01)

(52) U.S. Cl. ..... 52/747.11; 52/386; 52/387; 52/385

(58) Field of Classification Search ..... 52/384–387, 52/389, 122.1, 125.2, 125.3–125.5
See application file for complete search history.

(56) References Cited

U.S. PATENT DOCUMENTS

| | | | | |
|---|---|---|---|---|
| 3,341,996 | A * | 9/1967 | Jones et al. | 52/309.13 |
| 4,135,338 | A | 1/1979 | Malavasi | |
| 4,577,444 | A | 3/1986 | Sanderson | |
| 4,628,645 | A * | 12/1986 | Tafelski, Jr. | 52/169.1 |
| 4,996,784 | A | 3/1991 | Hsu | |
| 5,003,744 | A * | 4/1991 | Taylor | 52/308 |
| 5,014,488 | A | 5/1991 | Evangelos | |
| 5,323,575 | A * | 6/1994 | Yeh | 52/177 |
| 5,418,036 | A * | 5/1995 | Tokikawa et al. | 428/120 |
| 5,590,500 | A | 1/1997 | McCue | |
| 5,619,833 | A * | 4/1997 | Neff | 52/506.07 |
| 5,640,821 | A * | 6/1997 | Koch | 52/698 |
| 5,761,867 | A * | 6/1998 | Carling | 52/386 |
| 5,916,102 | A | 6/1999 | Peyton | |
| 6,189,289 | B1 | 2/2001 | Quaglia | |
| 6,367,218 | B2 | 4/2002 | Lombardo | |
| 6,659,023 | B2 | 12/2003 | Saltzman | |
| 6,694,689 | B1 | 2/2004 | Scott | |
| 6,715,246 | B1 * | 4/2004 | Frecska et al. | 52/220.6 |
| 6,751,912 | B2 | 6/2004 | Stegner | |
| 6,751,916 | B1 | 6/2004 | Ritzer et al. | |

(Continued)

FOREIGN PATENT DOCUMENTS

WO WO9941814 8/1999

(Continued)

OTHER PUBLICATIONS

The International Search Report and the Written Opinion of the International Searching Authority as received in related PCT application PCT/US2010/034727. Korean Intellectual Property Office. Feb. 11, 2011.

*Primary Examiner* — Eileen Lillis
*Assistant Examiner* — Alp Akbasli
(74) *Attorney, Agent, or Firm* — McKeon Meunier Carlin Curfman

(57) ABSTRACT

A tile system includes a tile and at least one removable tile insert. One of the tile and the at least one tile insert has securing means for removably retaining the at least one insert within or to the tile. The tile is configured to be installed on a surface through conventional means. The insert may incorporate both decorative and/or functional features and may be removed, replaced and/or reused to change the appearance of a single tile, multiple tiles, mural, liner or decorative scheme.

10 Claims, 8 Drawing Sheets

U.S. PATENT DOCUMENTS

| | | | | |
|---|---|---|---|---|
| 6,990,777 | B2 * | 1/2006 | Poliacek et al. | 52/384 |
| 7,197,855 | B2 * | 4/2007 | Della Pepa | 52/460 |
| 2003/0066258 | A1 * | 4/2003 | Chang | 52/387 |
| 2003/0097808 | A1 * | 5/2003 | Sabatini | 52/384 |
| 2004/0093819 | A1 * | 5/2004 | Ritzer | 52/384 |
| 2005/0246989 | A1 | 11/2005 | Pringle et al. | |
| 2005/0257436 | A1 | 11/2005 | Vanderpol | |
| 2006/0260251 | A1 * | 11/2006 | Hayashi et al. | 52/582.1 |
| 2007/0039267 | A1 | 2/2007 | Swanson | |

FOREIGN PATENT DOCUMENTS

| | | |
|---|---|---|
| WO | WO0053865 | 9/2000 |

* cited by examiner

TILE SYSTEM AND METHOD

RELATED APPLICATIONS

This application claims priority and is entitled to the filing date of U.S. application Ser. No. 11/364,661 filed Feb. 27, 2006, and entitled "Tile System and Method" which claims priority to U.S. Provisional application Ser. No. 60/656,651 filed Feb. 25, 2005, and entitled "Method and Apparatus for Installing Removable and Replaceable Tiles." The contents of the aforementioned applications are incorporated by reference herein.

INCORPORATION BY REFERENCE

Applicant hereby incorporates herein by reference any and all U.S. patents and U.S. patent applications cited or referred to in this application.

BACKGROUND OF THE INVENTION

1. Field of the Invention

Aspects of this invention relate generally to tiles, and more particularly to systems and methods for removing and replacing inserts within such tiles.

2. Description of Related Art

Tiles are commonly used in the construction industry on the surface of floors, walls and countertops of both commercial buildings and private homes. Tiles are also used to cover outdoor surfaces such as cement, walls, fountains, barbeques, fireplaces and countertops. Tiles may be formed in nearly any size and shape. Most commonly, tiles are formed in a square or rectangular shape from building materials such as stone, ceramic, composite, metal, porcelain, or plaster.

Tiles are typically attached to a surface such as floors and walls with adhesive building materials, such as mastic, grout, Thin Set®, mortar, or cement. Therefore, if a tile becomes worn or broken, the process to remove and replace the tile is difficult, particularly for the layman. The process necessarily involves breaking an adhesive to remove the tile and applying a new adhesive to secure a replacement tile. Often, the tile, surface, or surrounding tiles will be damaged or broken in the process.

In addition to functional purposes, tiles are also important for their decorative and aesthetic appeal. For example, tiles may be used to form a pattern on a kitchen or bathroom wall. Patterns may reflect colors, or a theme, designed to an occupant's preferences, or may be arranged in a collection of tiles to create a mural, picture or pattern. Unfortunately, if the occupant wishes to replace all or a portion of a tile, or mural, so as to form a different pattern, color or theme, the typical process again necessarily includes the breaking and application of adhesives and often results in the damage or breaking of the tile, surface or surrounding tiles. In view of the foregoing, it is desirable to have a system and method for installing tiles in which the decorative surface may be changed or altered in whole or in part without applying or breaking permanent or temporary adhesives. It is also desirable for such a method to utilize standard tile technology so an installer will be able to install the tile without the need for special or new skills, tools, or technologies that will alter or slow the tile laying process.

The following art defines the present state of this field:

U.S. Pat. No. 4,135,338 to Malavasi is directed to a preformed modular element for forming floor and wall coverings in combination with tiles and the like. The assembled modular elements define an array of regularly shaped cavities, each adapted to receive at least one tile. The cavities are preferably of a lesser depth than the tile thickness, thus resulting in an array of grooves between adjacent tiles, corresponding to the modular elements that separate the tiles and are depressed of the top faces thereof; finishing strips being received in the grooves of such a thickness to be flush with the tile top faces.

U.S. Pat. No. 4,577,444 to Sanderson is directed to a changeable wall structure including a frame which removably holds a plurality of inner decorative panels having displays on one or both sides. A combination of a shelf, a shelf extension, and a support are selectively secured to the frame by mounting brackets. These brackets include upper, lower and intermediate support brackets which permit the support of panels in upper and lower positions, in intermediate positions, and in rearward positions and forward positions. Decorative panels are employed, and the forward or outer panels can partially or totally conceal one or more of the inner panels from view. Each decorative panel is preferably changeable and reversible.

U.S. Pat. No. 4,996,784 to Hsu is directed to an integral picture frame with quick changeable flexible decoration part including an annular inner border portion with a inner convex surface, an annular intermediary protrusion portion and an annular outer border portion with an outer convex portion. A number of spaced first ribs formed on an outer surface of the annular inner border portion are attached to a first edge of a first annular flat seat at a lower part of each first rib and thereby defining a first compartment among each two first ribs and the first flat seat. A number of spaced second ribs formed on an inner surface of the annular outer border portion are attached to a first edge of a second annular flat seat at a lower part of each second rib and thereby defining a second compartment among each two second ribs and the second flat seat. Both edges of the annular intermediary protrusion portion respectively protrude upwardly from a second edge of the first annular flat seat and a second edge of the second annular seat and then centrally curved forming a convex surface. A flexible decoration part is changeably engaged onto a front side of the picture frame by means of deformation of two edges of the decoration part such that the deformation parts of two edges of the decoration part are respectively fitted into the first compartments and the second compartments.

U.S. Pat. No. 5,014,488 to Evangelos et al. is directed to a new method for the installation of building tiles without any adhesive materials (fine grained sand and cement or glues) or joint fillers (e.g. stucco), directly onto a bare wall or floor without any prior preparation of the latter. This method shows substantial advantages and is implemented using frame-plates mountable onto the wall or floor and standardized tiles with engagement means, suitable to match corresponding engagement means of the frame plates. An illustrative view of the installation process with the frame plates and tiles of the invention is presented in FIG. 16.

U.S. Pat. No. 5,590,500 to McCue is directed to a decorative and protective structural tile matrix for covering a base surface, such as a wall or countertop. A set of tiles comprise a subset of fixed tiles and a subset of removable tiles. The fixed tiles are permanently attached to the base surface by an adhesive. The removable tiles each provide a precast flexible grout sleeve of an elastomeric material, such as a plastic or rubber compound. The sleeve conforms to, and extends around, at least a portion of a peripheral edge of the removable tile. Each of the removable tiles takes a position between the fixed tiles such that the sleeve is compressed between the peripheral edges of the fixed tiles and the removable tile. As such, a compressive force is generated for holding each removable tile in place on the base surface. Alternatively, the sleeve is fixed to the base surface and has an outwardly extending frame defining pockets for insertion of a number of removable tiles. The removable tiles are held in the pockets by compressive forces applied to the frame from each adjacent tile. In use, the removable tiles may be exchanged with alternate removable tiles, such that an area decorated by a first set of removable tiles can be quickly given a new decorative appearance by replacing the first set of removable tiles with a second, different set of removable tiles.

U.S. Pat. No. 5,916,102 to Peyton is directed to a removable tile display including a decorative tile, a holder for the tile, and releasable adhesive for removably securing the back surface of the tile to the holder. The holder includes a cavity in which the decorative tile is positioned. Decorative tiles of various designs may be substituted within the holder as desired. The tile and holder combination may be permanently affixed to a wall or other planar surface, or they may be placed for vertical orientation within a tabletop support.

U.S. Pat. No. 6,189,289 to Quaglia et al. is directed to a flooring which can be locally removed and relaid rapidly any number of times, comprising a plurality of tiles (2), a plurality of plate-shaped supports (5) arranged quincuncially below the tiles (2), and means of fixing the tiles to the plate-shaped supports (5).

U.S. Pat. No. 6,367,218 to Lombardo is directed to a removable tile wall covering that includes a number of ceramic tiles held on the wall surface with disengageable-reengageable VELCRO fasteners. The wall covering is simple and inexpensive to install, and the tiles are easily removed for cleaning or redecoration.

U.S. Pat. No. 6,659,023 to Saltzman et al. is directed to an article of furniture bearing a plurality of tiles on a top surface. A frame is disposed on the top surface for removably securing said tiles thereon. The frame comprises an external frame member surrounding and forming a border along the top surface, and an internal frame comprising a centrally disposed spine with a plurality of ribs extending outward from the spine at regularly spaced intervals. The internal frame is seated within the external frame and subdivides the area therein into a plurality of recesses. The tiles are removably seated within the recesses anywhere within the table top grid, and they can be rearranged on the surface within the recesses according to the whim of the user. Each tile bears a distinctive color or finish, and the user may arrange the tiles on the surface of the table according to his or her whim, for purposes of artistic expression, or purely for entertainment.

U.S. Pat. No. 6,694,689 and International Patent Application No. PCT/US99/03122 to Scott et al. are directed to modular flooring systems and methods using at least one free-lay support module. The free-lay support module includes a baseplate and a frame member having a first arm and a second arm that meet and form an angle. Replaceable wear surface modules with or without a backing structure fit within the baseplate. The top of frame partially overlays the replaceable wear surface modules that may be carpet, carpet tile, vinyl flooring, wood flooring, wood parquet flooring or a variety of other materials. In still another embodiment, this invention provides for a free-lay support module that is self-contouring or self-leveling. In yet another embodiment this invention provides a replaceable wear surface modular flooring structure utilizing floor grid members having a "horizontal arm" and a "vertical arm", each of which are in the form of an open U-shaped channel. A trim member has a decorative upper surface and any of a variety of cross-sectional shapes with downward facing members that engage the floor grid members providing a decorative and protective cap on the top of such grid members. In still another embodiment, power systems, communications systems, and/or cable systems reside within the channels.

International Patent Application No. PCT/US00/06268 to Scott et al. is directed to a free lay flooring system including a base matrix (12) for securing a replaceable wear surface (14) to a floor or subfloor. The base matrix includes a plurality of flooring recesses (16) sized to receive the replaceable wear surface. Ceramic tile, carpet, carpet tile, fabric, vinyl flooring and wood are a sample of materials suitable as the replaceable wear surface (14). When viewed from above, the base matrix (12) and replaceable wear surface (14) appear as a "groutless" tile flooring structure.

U.S. Pat. No. 6,751,912 to Stegner et al. is directed to a tile flooring system composed of modular interlocking tiles. Each modular interlocking tile is adapted to be coupled to another modular interlocking tile. Each tile includes a body having a playing surface, two male interlocking sides, and two female interlocking sides. Each tile also includes an interlocking mechanism coupled to the male interlocking sides and the female interlocking sides. The interlocking mechanism is adapted to allow the modular interlocking tile to be connected to the another modular interlocking tile in a staggered fashion.

U.S. patent application Ser. No. 11/133,699 to Vanderpol is directed to a removable tile mural assembly constructed in such a manner so as to appear to be a part of, or set into, a backsplash or tiled wall, but which is actually removable from the wall surface. The removable tile mural assembly comprises a substantially rigid base member to which is fixed on the front outer peripheral edge thereof a tile frame which defines a framed surface area. A tile mural comprising at least one tile is fixed to the front side of the base member within the defined framed surface area. Mounting means is provided for removably mounting the assembly to a wall surface. The tile mural may include rope lighting and/or the tile mural may be back-lighted.

The prior art described above teaches modular elements for covering floors and walls with tiles and the like, changeable wall panel structure, an integral picture frame with quick changeable flexible decoration part, a tile system, a removable tile display, tile flooring, a removable tile wall covering, tile-topped furniture with removable tiles, a modular tile and tile flooring system, modular flooring systems and methods, free lay ceramic tile flooring systems and methods, and a removable tile mural, but does not teach a tile with one or more inserts that may be removed, replaced and/or reused to change the appearance of a single tile, multiple tiles, a mural, a liner or a decorative scheme and that may also be used to add or hide functional elements on a surface.

Thus, there is a need for a technology where a tile can be laid in a field of tiles, or can be the entire field, where such tiles can be installed in the same manner as traditional tiles in which the decorative or functional surface elements of the tile may be altered without the need to damage the tile, the surface or the surrounding tiles or the need for any special tools, skills or technologies. Aspects of the present invention fulfill these needs and provide further related advantages as described in the following summary.

SUMMARY OF THE INVENTION

Aspects of the present invention teach certain benefits in construction and use which give rise to the exemplary advantages described below.

Aspects of the present invention generally relate to the use of tiles in the design and construction of buildings, furniture and landscaping. More particularly, aspects of the present invention relate to a system and method for providing functionality including, but not limited to, (1) creating a tile with one or more removable, reusable and replaceable inserts (when used in this patent, the terms "tile", "tiles", "insert" and "inserts" should be construed in both their singular and plural), the face of the insert comprising a portion or the entirety of the face of the tile, (2) creating a tile which can be utilized to create a removable and replaceable mural, liner, or design, (3) creating tiles with functional items that can be obscured or accessed through an insert, (4) creating inserts with functional items that when inserted into a tile will integrate into a tile surface, (5) creating inserts that have open space on the rear of the insert that can be utilized to conceal and protect items of interest or functional elements, or (6) creating inserts that are clear or translucent and/or formed with one or more cut-outs so as to be able to backlight the insert through a lighting assembly installed in the tile.

A first aspect of the invention is a system for creating a tile with removable inserts. In the exemplary embodiment, the insert fits into the tile so as to minimize any space, or to cover any space, between the insert and the tile and is removably installed in the tile without the need for special materials, tools, spacers or devices. The insert may or may not require a securing means to hold the insert in the tile. An exemplary securing means is a magnetic attraction between one or more elements of the insert and one or more elements of the tile, though other securing means include, by way of illustration, but not limitation, Velcro®, a securing member, a retaining lip, a tongue and groove, mating surfaces, a temporary adhesive, a lock and key, a latch, female and male counterparts in the tile and insert, a net fit as by pressure between the insert and the tile, or a net fit where only natural or frictional forces are required.

In another aspect of the invention, the tiles can be laid side by side or in any pattern to create a mural, liner or other decoration or design which can be altered by removing and replacing some or all of the inserts. The inserts may or may not make up one or more outside walls of the tile.

In another aspect of the invention, the tiles may contain raised borders between inserts or may have an open space to receive a variety of different shaped inserts that may form a mural, field, or random arrangement of tiles with replaceable inserts.

In another aspect of the invention, the insert contains a functional element with the base in a shape to fit into a tile. By way of example only, the removable insert may be a spice holder, a hook or loop to hang kitchen utensils, a bottle opener, a trivet, a coaster, a cutting board, an Ethernet connection, a phone connection, an electrical plug, a light, or a writable and erasable surface. These elements may be self contained, connected to elements protruding through a tile, or connected to a tile. In addition, two or more tiles may together be used to create a functional element. By way of example only, two inserts may each support one side of a towel rack.

In another aspect of the invention, the removable insert covers a functional element of a residence or commercial building. By way of example only, this could be a telephone plug, electrical socket, gas turn-on socket, ethernet plug, or switch. The insert may be solid so as to hide the functional element, which will only be used when the insert is removed, or may have an opening for a cord or other item to pass so the functional element can be utilized even when the insert is in place within the tile, or may be clear or translucent to expose a lighting element incorporated in, or wired into or through, the tile.

In another aspect of the invention, the tile with removable insert will have a hollow portion in which an item of value may be hidden. By way of example only, this could be a key or jewelry.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

The present invention is generally directed to a system and method for installing a tile with removable inserts and removing and replacing the inserts. In the following description, numerous specific details are set forth in order to provide a thorough understanding of the present invention. It will be understood, however, to one skilled in the art that the present invention may be practiced without some or all of these specific details. In other instances, well known process operations have not been described in detail in order not to unnecessarily obscure the present invention. In addition, all uses of the words tile and insert or tile insert should be read both in their singular and their plural where each application may consist of a single tile and insert or tile insert, multiple tiles and/or multiple inserts or tile inserts, and/or multiple inserts or tile inserts in a single tile.

Figure 1:
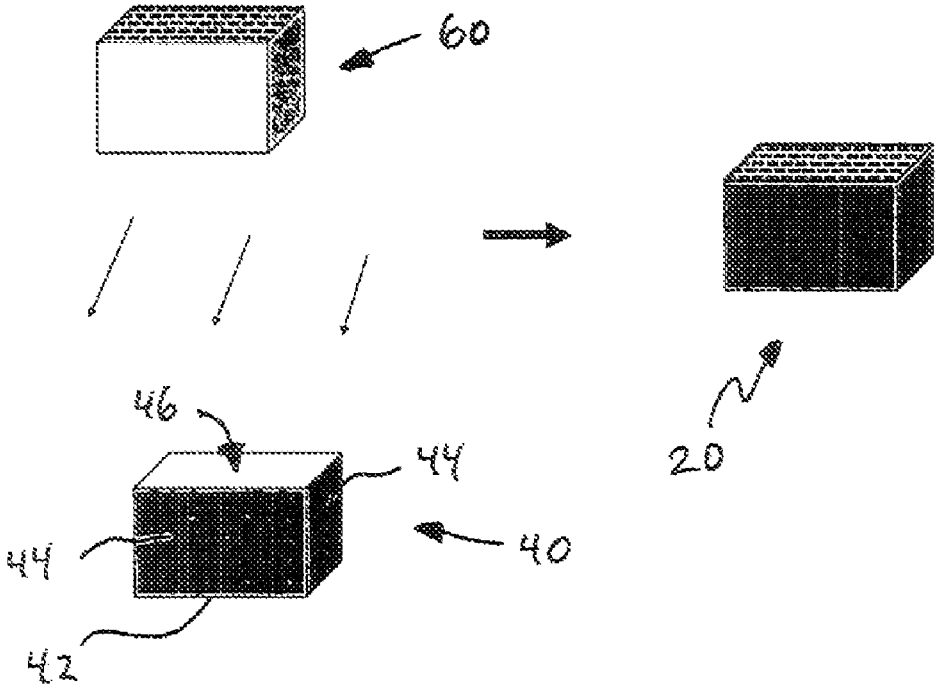
FIG. 1 illustrates a tile system according to one aspect of the invention.

FIG. 1 illustrates a tile system 20 in accordance with one embodiment of the present invention. The tile 40 in this instance is essentially a tile with a hollow interior 42 and four side walls 44 so as to define a receptacle 46 in which a tile insert 60 may be inserted or attached. For purposes of this example only, the tile 40 shown contains only one to space or receptacle 46 in which to place an insert. A single insert or multiple inserts may be inserted into the space. A tile for the purpose of this invention may be made in at least any of the following forms: (i) a tile as illustrated in FIG. 1, where the tile is made up of a back and four sides; (ii) a backing only on which to attach one or more inserts; (iii) four sides and no back in which an insert may be inserted; or (iv) any other format in or to which one or more tile inserts may be temporarily inserted or attached, removed and replaced. As such, the tile may be defined by a back wall, a side wall, or any combination of such, whereby the insert may be received within a pocket defined by such walls or may be removably secured to a generally planar surface of the tile. Those skilled in the art will appreciate that while one or more of these forms is shown and described, the invention is not so limited, but that numerous other forms for both the tile and the insert may be employed without departing from the spirit and scope of the invention. The tile 40 may be made out of any material, or a combination of materials. Examples of common materials from which tiles may be made include, but are not limited to, metal, ceramic, porcelain, stone, plastic, plaster, glass, composite material, resin or wood.

Figure 2:
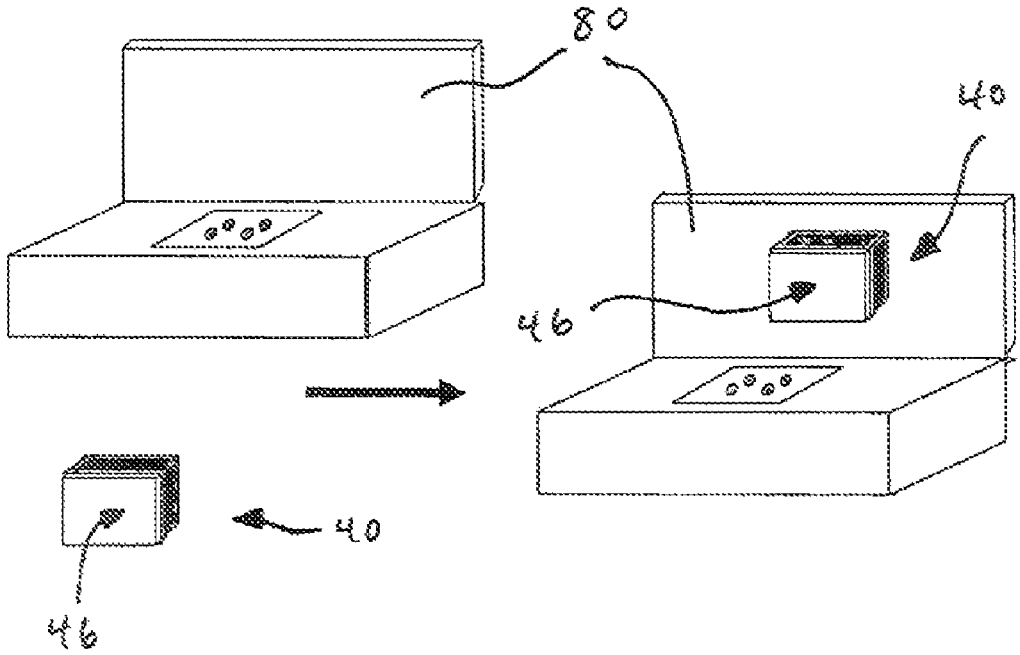
FIG. 2 illustrates the tile of FIG. 1 secured to a surface with the insert removed.
Figure 3:
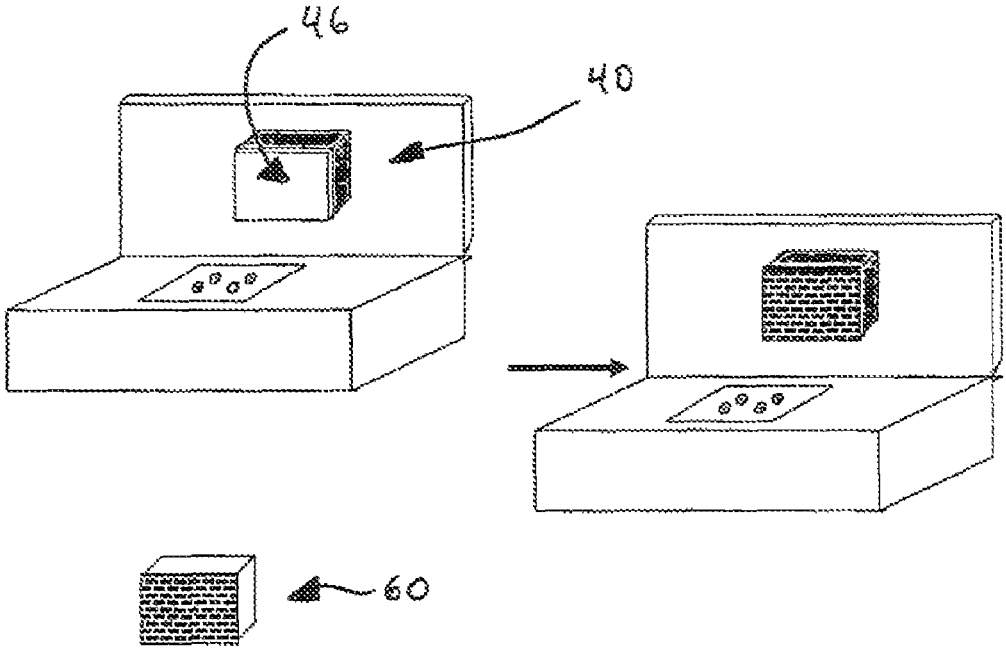
FIG. 3 illustrates a tile insert placed inside the tile of FIG. 1.

FIG. 2 illustrates that the tile 40 is secured to a surface 80 such that the receptacle 46 faces outwardly for removable receipt of one or more inserts 60 (FIGS. 1 and 3). The surface may include, among other surfaces, a countertop, wall, floor, furniture, or any other surface on which tiles are, or may be, used. Generally speaking, the surface 80 is a planar backing surface, although the invention is not so limited. For illustrative purposes only, the surface 80 in the example shown is a kitchen backsplash. The tile 40 can be secured to the surface by: (i) Thin Set® or mortar in the same manner, in the same field, and at the same time as any traditional tile that does not include an insert may currently be set, (ii) nails, screws or other fasteners; (iii) glue, mastic, grout, or other permanent or temporary adhesive; or (iv) by any other method now known or later developed. The tile 40 may be placed on a surface by itself, as shown in the exemplary embodiment of FIG. 2, within a field of other traditional tiles or tiles with inserts, or amongst any other material or surface covering. For illustrative purposes only, the current example shows the tile attached to a surface without any surrounding surface covering.

Figure 4:
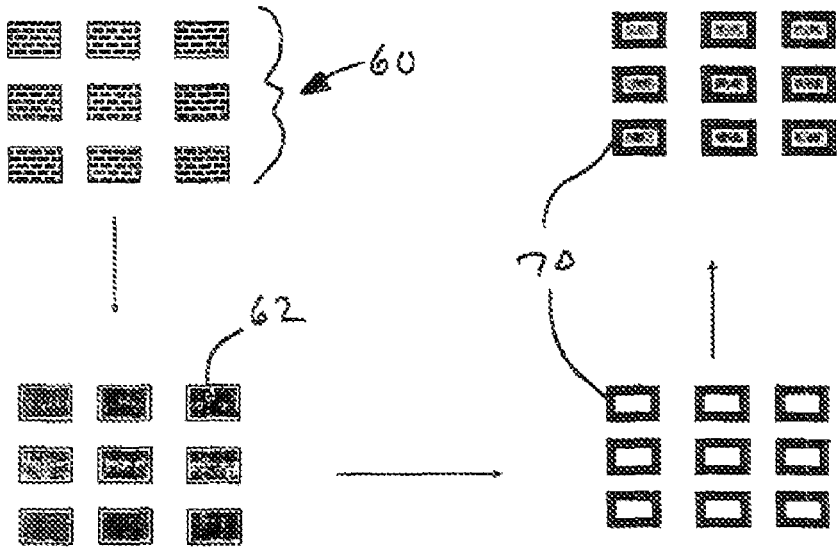
FIG. 4 illustrates tile inserts according to another aspect of the invention.

FIG. 3 illustrates that a tile insert 60 is placed into the tile 40. The insert 60 is secured to the tile using securing means. The securing means may be provided only on the tile, only on the tile insert, or on both the tile and tile insert. A preferred method is for two pieces of metal with magnetic attraction to each other to be incorporated into the material—one in the tile 40 and the other in the tile insert 60. The pieces of metal may be two magnets, or one magnet and one piece of metal which is attracted to the magnet. For illustrative purposes only, FIG. 4 provides one example where a magnet 70 is secured to the surface of the back side 62 of each insert 60 by an adhesive (not shown) and the tile 40 (FIGS. 1-3) is constructed entirely of metal. Alternatively, a magnet and/or a piece of metal may be: (i) incorporated into the structure of the tile and/or the tile insert either during or after manufacture; (ii) attached to the tile and/or tile insert by a fastener; or (iii) attached to the tile and/or the tile insert by any other means now known or later developed. In addition to the use of magnets, other means for securing the insert within the tile include, but are not limited to, Velcro®, a retaining lip, a tongue and groove between the tile and the tile insert, mating surfaces, a temporary adhesive, a male and female counterpart or counterparts in the tile and insert, a net fit as by pressure between whole or part of the insert and whole or part of the tile, a net fit between whole or part of the insert and whole or part of the tile where only natural or frictional forces are required, a securing member such as, for example, a latch or other clip mechanism incorporated into the tile insert and/or the tile, a piece of metal, plastic, rubber or other material inserted between the tile insert and the tile (e.g., a shim) or attached to the tile, which can hold the insert in place by pressure or which can form a lip or covering over a portion of the insert and secure the insert in place as in FIG. 6 discussed below, grooves, edging or lining on the tile insert and/or the tile, suction or suction cups, tongue and groove, male and female counterparts in the tile and the tile insert, lock and key, or any other method that will secure the tile insert to the tile while allowing the insert to be removed and replaced without breaking a permanent adhesive or other such permanent assembly means. It will be appreciated by those skilled in the art that other securing means now known or later developed in the art may be employed in the present invention without departing from its spirit and scope.

Removal of the tile insert 60 may be accomplished by holding a magnet to the insert and pulling the magnet, and thus the insert, away from the tile 40. A new tile insert may then be placed in the tile. In addition to being removed with a magnet, a tile insert may be removed by suction where a suction cup is placed on the tile and pulled away so that the insert is removed, or mechanically by inserting an object between the insert and the tile, inserting an object between an insert and an adjacent insert in the instance where the tile has multiple inserts or does not have four sides, by holding an element on the insert and pulling away, by a tool that attaches to an element on the insert, or by any other method.

Figure 5:
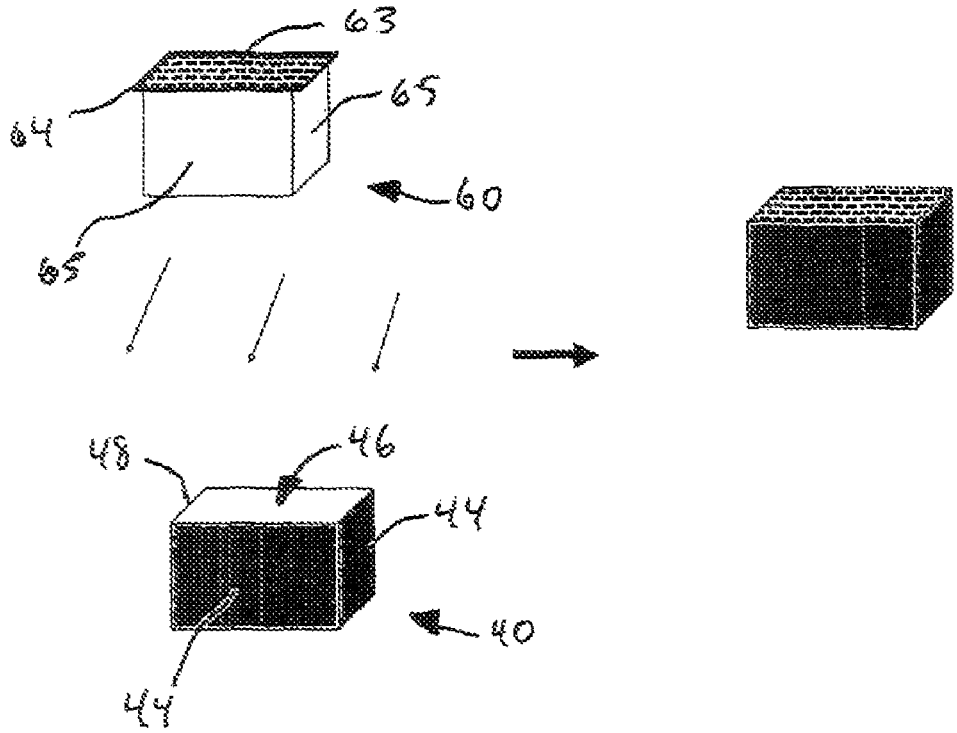
FIG. 5 illustrates a tile insert according to another aspect of the invention inserted into the tile of FIG. 1.

Once a tile insert is placed into a tile, the top edges of the tile may or may not be visible depending on the desired application. The surface of the tile insert may make up a small fractional part of the surface of the tile, the entire exposed surface, or any portion thereof. Turning to FIG. 5, if the tile 40 has four sides 44 so as to define an outwardly-facing tile face 48 and an outwardly-opening receptacle 46, the tile insert 60 can be configured with an outwardly-facing insert face surface 63 from which a reduced profile body 65 extends inwardly, whereby the insert face surface defines a lip 64 about the perimeter of the insert. In this way, when the insert 60 is inserted within the receptacle 46 of the tile 40, the lip 64 covers substantially all of the tile face 48 as shown in FIG. 5. In the exemplary embodiment, the walls 44 of the tile 40 that form the receptacle 46 define a receptacle perimeter, or the inside dimensions of the receptacle pocket, while the outside margin of the face of the insert as formed by the lip defines a face perimeter, whereby the face perimeter extends beyond the receptacle perimeter such that the receptacle is not visible when the insert is secured to the tile. Alternatively, the lip could be configured to extend from only one or more edges of the insert surface 63 so as to cover only a portion of the tile face 48. In another exemplary embodiment, the insert may also be constructed without a lip and may fit in a tile in a manner to not cover any of the exposed surface portion of the tile. In this exemplary embodiment, the insert body defines a body perimeter that is substantially equivalent to the receptacle perimeter such that the receptacle is essentially not visible when the insert is secured to the tile. That is, in the case where some kind of natural or frictional net fit is set up between the insert and tile, it is preferable that the insert be in contact with at least one wall of the tile. However, even where some other mechanical or magnetic securing means is employed, as explained above, in the exemplary embodiment of the invention wherein the insert does not cover the entire tile face, it is preferable that the insert be substantially in contact with, or immediately proximate of, the wall(s) of the tile in the areas where there is no lip such that no gap between the tile and insert is visible to the naked eye, such a gap being distinguishable from the natural line that would be visible as marking the respective perimeters of the tile receptacle and insert.

Figure 6:
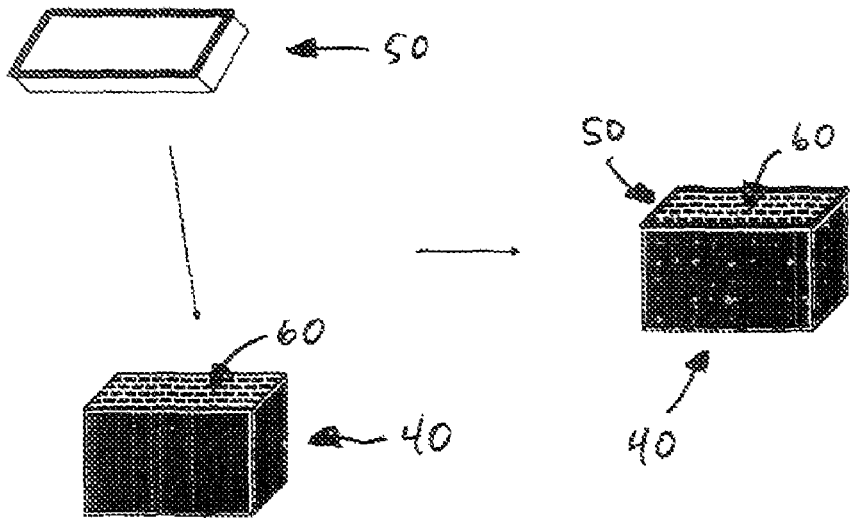
FIG. 6 illustrates a tile insert and liner according to another aspect of the invention inserted into the tile of FIG. 1.

In another exemplary embodiment, a liner 50 may be attached to the tile 40 or inserted into the tile 40 between the tile insert 60 and the tile 40 as shown in FIG. 6. Such liner 50 may be purely decorative, or may be both decorative and functional, serving as a means of securing the tile insert 60 in place as explained above. The decorative aspect of such a liner may serve any of a number of purposes, including, but not limited to, to cover the top edge of the tile, to create the appearance of a grout joint with a material textured and colored similar to grout, or to frame a single tile, group of tiles, insert or group of inserts.

Figure 7:
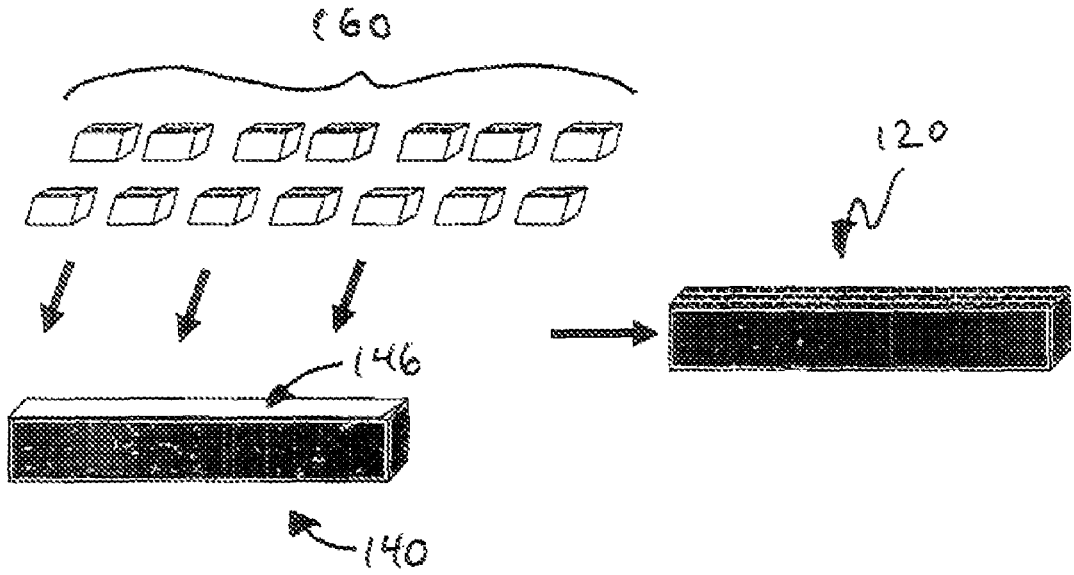
FIG. 7 illustrates a tile system according to another aspect of the invention.

FIG. 7 illustrates a tile system 120 including a tile 140 in accordance with another embodiment of the present invention. The tile 140 contains a single space 146 for multiple tile inserts 160. As with the single insert tile 40 shown in FIG. 1, the use of rectangular tiles is for illustrative purposes only. The tile inserts 160, as well as the tile 140 and the space 146 in the tile in which to place the tile inserts may be formed in virtually any shape that is desired. The number of spaces in such a multiple insert tile and the shape of the total space for the individual tile inserts are also easily changed to fit the configuration of the surface to which the tile is secured and the pattern of tiles desired. The individual spaces in a tile for insertion of each tile may be individually constructed, be combined into a single structure, be connected to the tile, be undefined so as to fit a number of different tile sizes or configurations, or be constructed as part of the tile. The tile may also be a flat panel or tray that is substantially planar without defined spaces for individual tiles or even side walls so that any number and configuration of inserts of different sizes may fit on or into the same tile, in which case the inserts can be formed substantially flat so as to rest on the tile.

Figure 8:
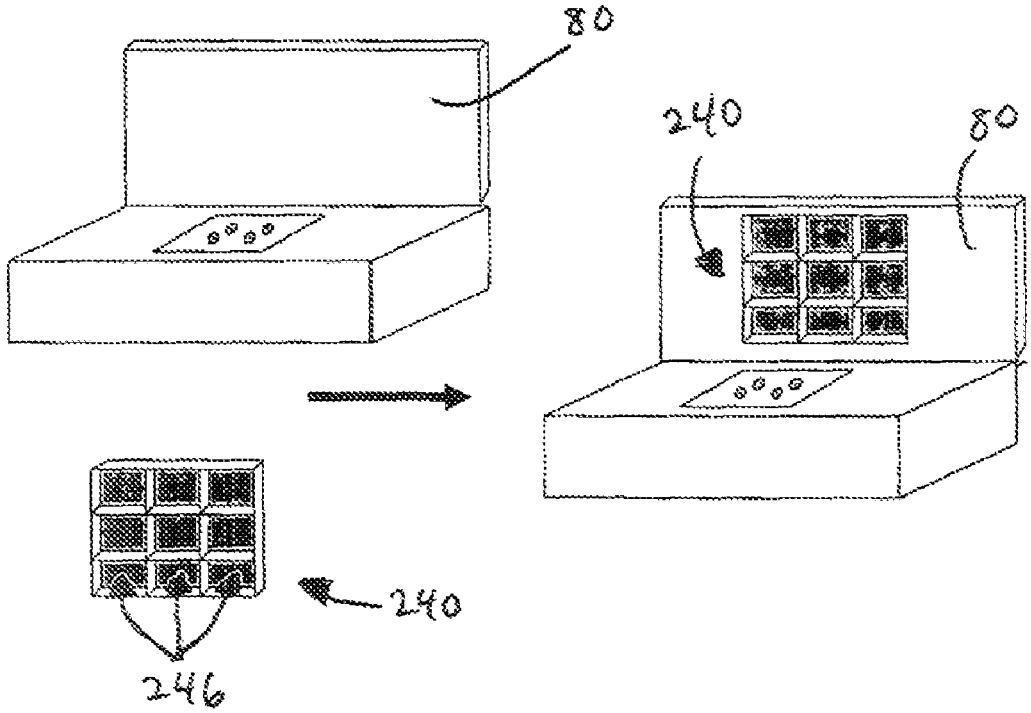
FIG. 8 illustrates a tile according to another aspect of the invention.
Figure 9:
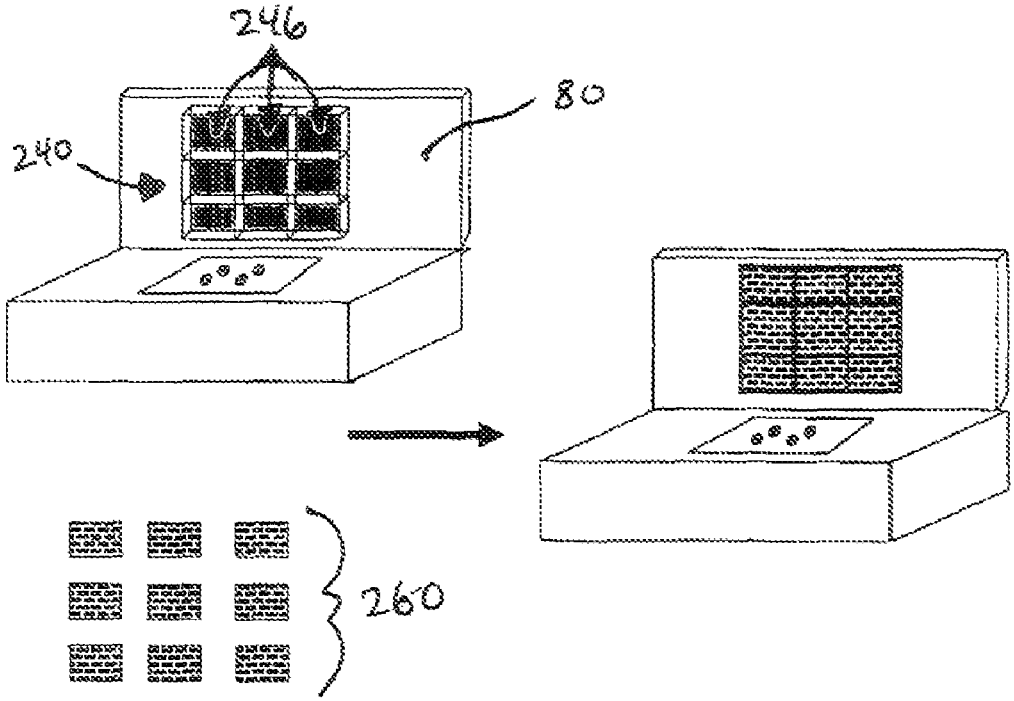
FIG. 9 illustrates tile inserts as shown in FIG. 1 inserted into the tile of FIG. 8.

FIG. 8 illustrates a tile 240 of yet another exemplary embodiment with multiple spaces or receptacles 246 for receiving individual tile inserts and attached to a kitchen counter backsplash surface 80. The tile 240 may be secured to the surface 80 in the same method as the single tile 40 of FIGS. 1 and 2, which is by Thin Set®, mortar, nails, screws or other fasteners, glue, mastic, grout, or other permanent or temporary adhesive, or by any other method now known or later developed in the art. Turning to FIG. 9, the tile inserts 260 are inserted into the tile 240 which holds multiple inserts in the same manner as a single tile. Such tile inserts 260 in a multiple insert tile 240 may also be attached to the tile by the same methods as the individual tile; that is, by the preferred method of two pieces of metal with magnetic attraction to each other or through any other means now known or later developed, as outlined above. Inserts in a multiple insert tile may also be removed and replaced with the same methods as used for a single insert tile.

Figure 10:
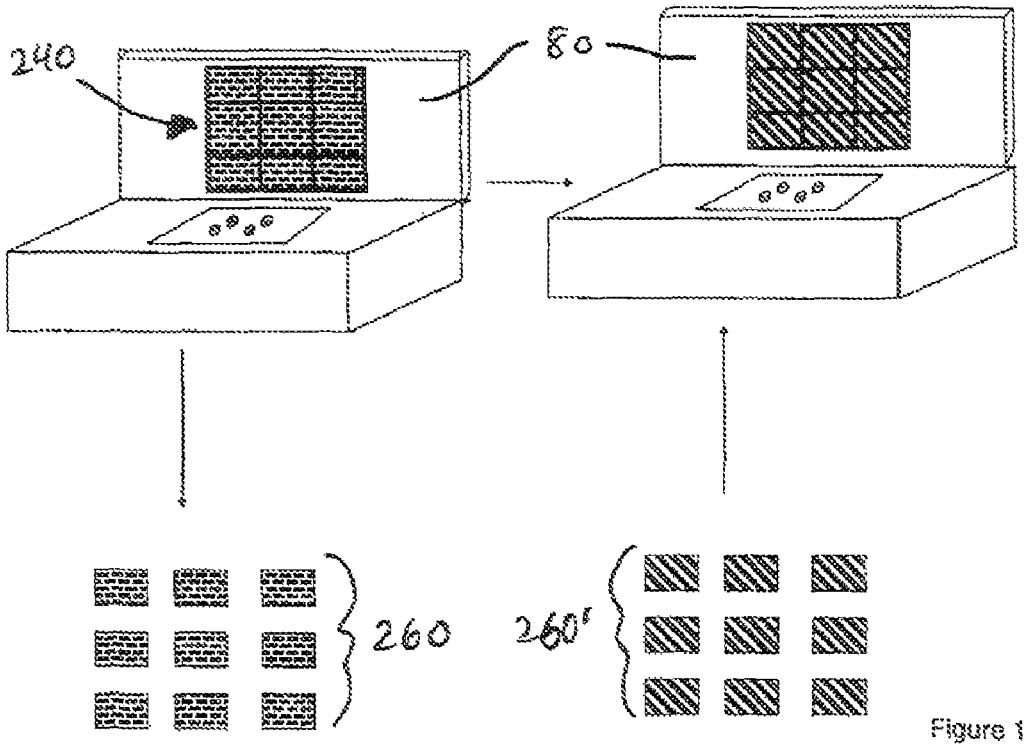
FIG. 10 illustrates the tile of FIG. 8 in use.

FIG. 10 illustrates a pattern of tile inserts 260 being removed and replaced within a multiple insert tile 240 attached to a kitchen backsplash 80 by a second set of inserts 260'.

The decorative aspect of replaceable tile inserts serves a number of purposes, including, but not limited to, changing the pattern on a surface without the need for traditional tiling skills or the mess associated with breaking an adhesive, and therefore making it practical to change the pattern with a greater frequency. In addition, personalized tile inserts may be created by a child or adult and displayed for a period of time until the owner chooses to remove such insert(s) and replace it or them with another personalized or manufactured insert(s).

Figure 11:
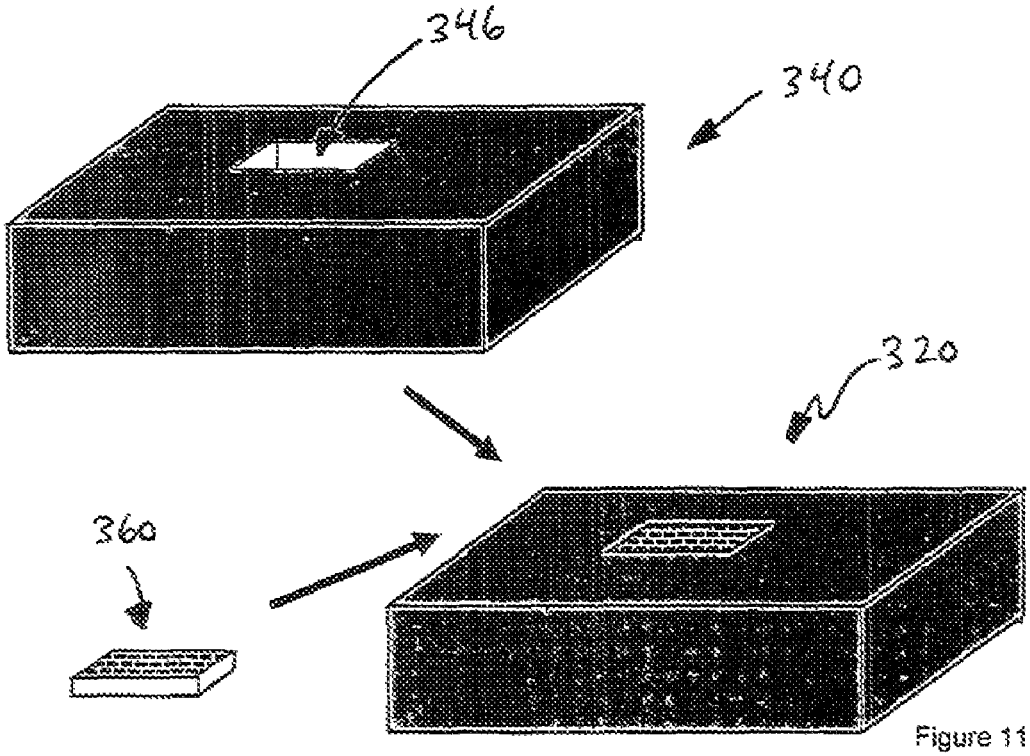
FIG. 11 illustrates a tile system according to another aspect of the invention.

In yet another embodiment of the tile system 320 of the present invention, as shown in FIG. 11, the tile insert 360 is again incorporated into a tile 340, only in this exemplary embodiment, the pocket or receptacle 346 formed in the tile 340 is relatively smaller, such that a smaller tile insert 360 may be inserted into the tile, secured in place, and removed and replaced by the same methods as described above. In this manner, a portion of the tile 340 is visible while only a portion is removably replaced as through an insert, providing a modified appearance from the previous embodiments.

Figure 12:
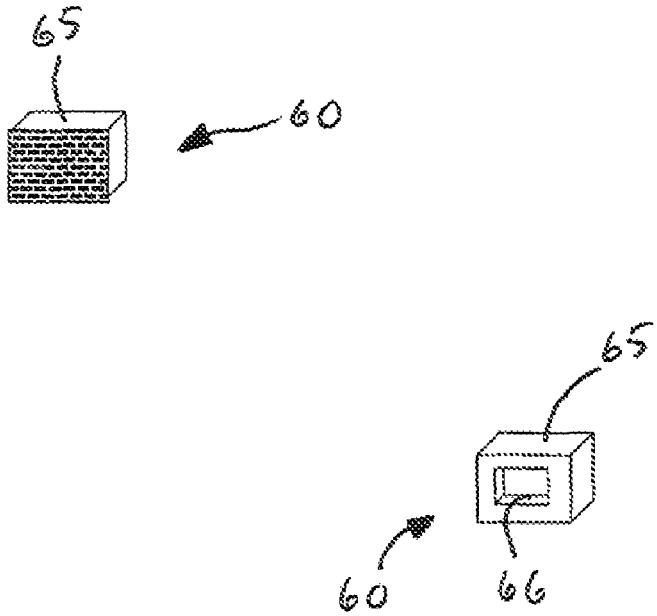
FIG. 12 illustrates a tile insert according to another aspect of the invention.

In another embodiment of the present invention shown in FIG. 12, a tile insert 60 as shown in any of FIGS. 1-11 may also be used as a storage device to store or hide an item. Such a tile insert 60 may be formed with a cavity 66, or hollow interior or incomplete body 65, to form a storage space. These "security tiles" may be used to hide objects from view. For example, jewelry, keys and other valuables may be placed inside a security tile to store and protect them from view and from theft. Such a tile insert may be temporarily removed to obtain the item and then replaced.

Figure 13:
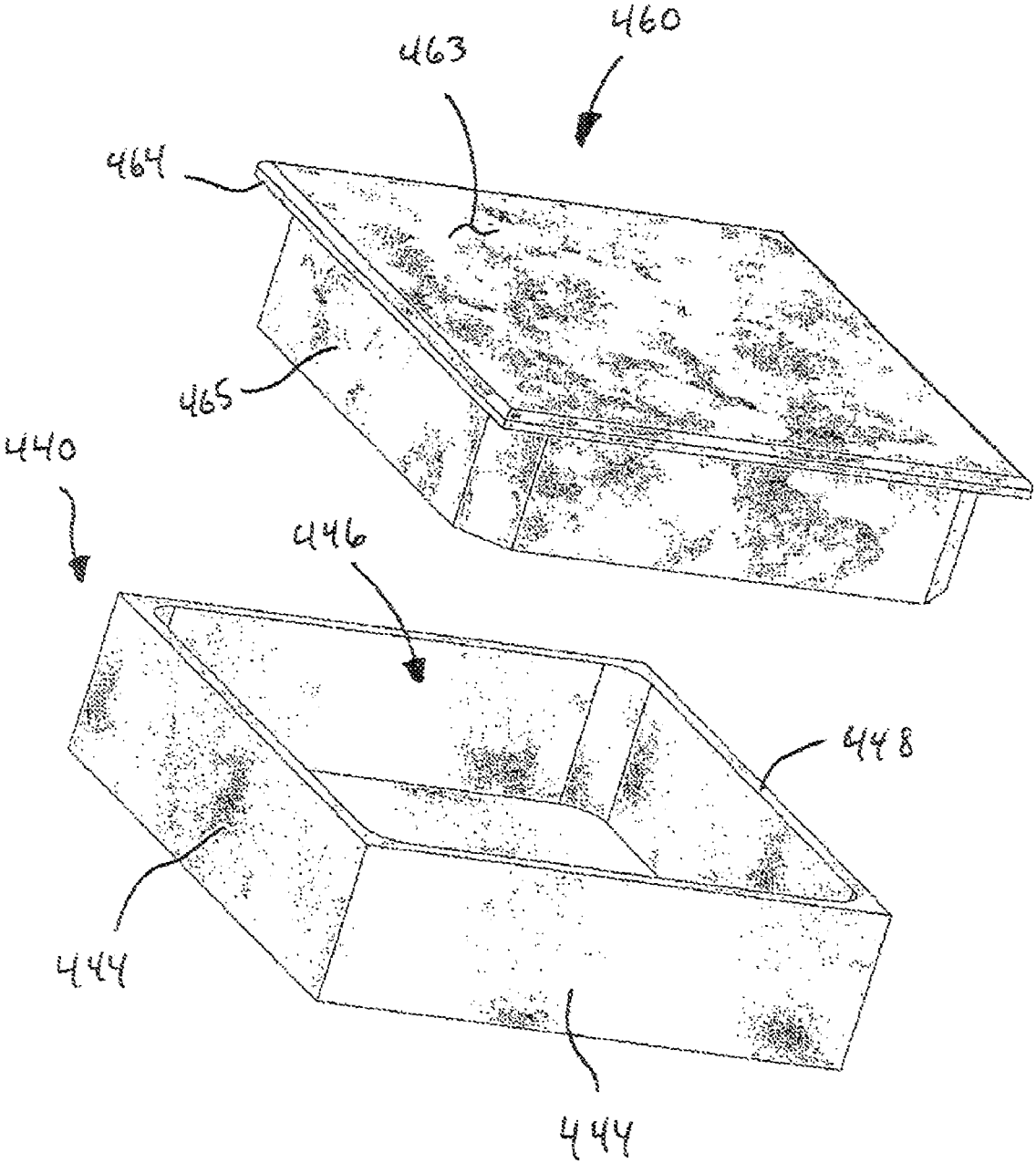
FIG. 13 illustrates a tile system according to another aspect of the invention.

In another embodiment of the present invention shown in FIG. 13, the tile 440 has four sides 444 so as to define an outwardly-facing tile face 448 and an outwardly-opening receptacle 446. The tile insert 460 is configured with an outwardly-facing insert face surface 463 from which a reduced profile body 465 extends inwardly, whereby the insert face surface defines a lip 464 about the perimeter of the insert. In this way, when the insert 460 is inserted within the receptacle 446 of the tile 440, the lip 464 covers substantially all of the tile face 448. Specifically, in this exemplary embodiment, the walls 444 of the tile 440 that form the receptacle 446 define a receptacle perimeter, or the inside dimensions of the receptacle pocket, and the outside dimensions of the walls 444 define a tile perimeter, while the outside margin of the face 463 of the insert as formed by the lip 464 defines a face perimeter, whereby the face perimeter not only extends beyond the receptacle perimeter such that the receptacle is not visible when the insert is secured to the tile, but the face perimeter is substantially equivalent to the perimeter so that the insert face is visibly seen as the entire tile with grout or other material in between the tiles installed on a surface as in the conventional fashion. In this way, the appearance of entire tiles can be altered by simply removing and replacing one or more inserts, with the resulting appearance being that of conventional tiles in every way. Moreover, because the tile 440 can be installed just as a conventional tile, the resulting equivalent appearance is achieved through a conventional installation process, not requiring any special skills, tools, training or know-how. In such an exemplary embodiment, the insert 460 may be removably secured within the tile 440 preferably as by a magnetic attraction or simply a net fit between a whole or part of the insert and a whole or part of the tile where only natural or frictional forces are required.

Figure 14:
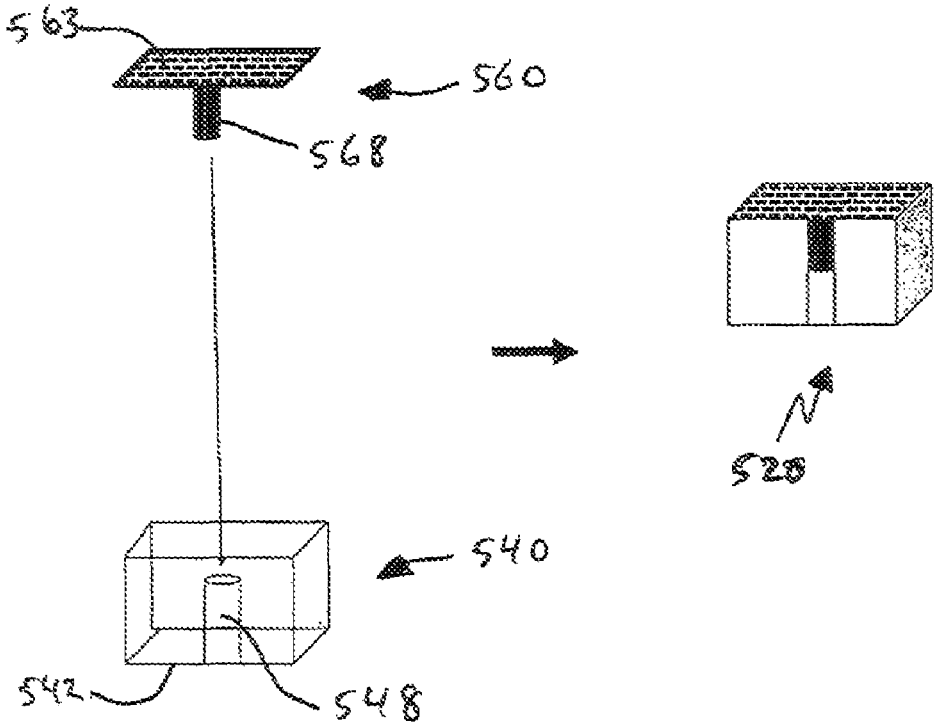
FIG. 14 illustrates a tile system according to another aspect of the invention.

In another embodiment of the tile system 520 of the present invention shown in FIG. 14, a securing means between the tile 540 and the tile insert 560 is illustrated wherein a male and female counterpart or counterparts in the tile and insert. Specifically, a male connector 568 is formed on the insert 560 so as to extend inwardly from the insert surface 563 and engage a female connector 548 formed so as to extend outwardly from the back wall 542 of the tile 540 when the insert 560 is inserted therein. It will be appreciated by those skilled in the art that while a certain male/female connector is shown, with the male portion extending from the insert and the female from the tile, the invention is not so limited. Rather, one or more connectors of a virtually infinite number of configurations now known or later developed may be incorporated into the present invention without departing from its spirit and scope.

Figure 15:
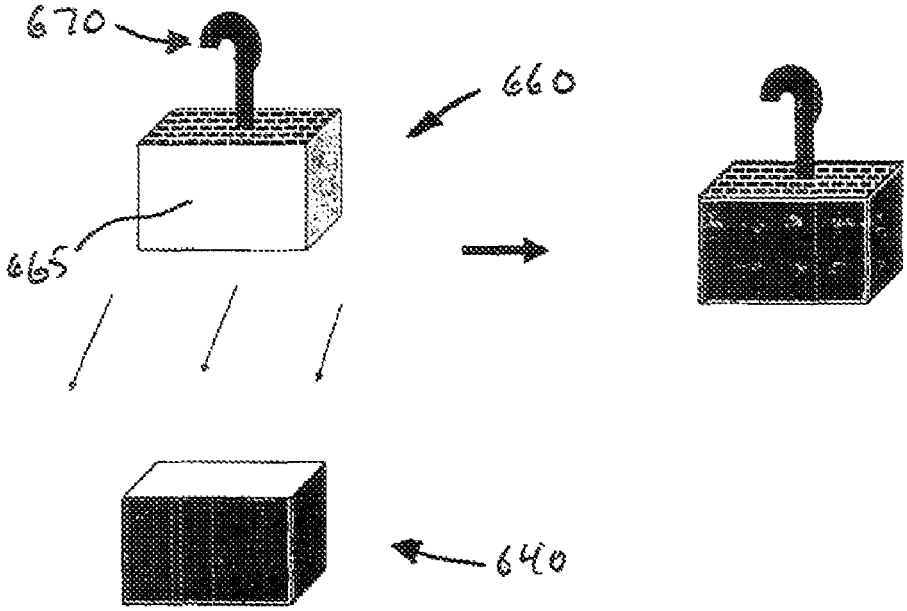
FIG. 15 illustrates a tile system according to another aspect of the invention.

In another embodiment of the present invention shown in FIG. 15, the insert 660 may contain other functional elements 670 with the base 665 in a shape to fit into a tile 640 as explained above. By way of example only, the functional element 670 is shown as a hook for holding or hanging kitchen utensils and the like. The functional element incorporated into the insert may be a spice holder, a hook or loop to hang, kitchen utensils, a container, a bottle opener, a telephone plug, an Ethernet plug, an electrical socket, a cable connection, an erasable white board, chalk board or other writing surface, a light, a rack, a trivet, a cutting board, or a coaster, or two inserts in the same or different tiles may form a towel rack. Thus, some functional elements are configured to be used with the insert in place within the tile and some are configured for use when the insert is removed, such that the tile effectively serves to store the functional element for later use. In another aspect of the invention, the removable insert covers a fixture of a residence or commercial building such as a telephone plug, Ethernet plug, electrical socket, gas turn-on valve, or switch, or the insert is a light diffuser as formed by a clear or translucent material and/or formed with one or more cut-outs, with a lighting element incorporated into or attached to the tile so as to backlight the insert. The fixture may reside in the wall and be accessible through an opening in the rear of the tile, or be connected to or integrated into the tile and/or the insert. Or, the insert may itself be configured with a lighting element. In the case of a fixture, the insert may have a solid face so as to hide the fixture, which will only be used when the insert is removed, or may have an opening for a cord or other item to pass so the fixture can be utilized even when the insert is in place within the tile. Any of these functional elements may be self contained, connected to elements protruding through a tile, or connected to a tile. By way of example only, a telephone cord may protrude through an opening in the back of a tile and connect to a phone plug in the insert. Alternatively, a telephone cord may connect to the tile which has a telephone plug integral to the tile and the insert has a rearward facing male telephone jack adapter which when the insert is inserted into the tile connects to the female phone jack of the tile and the insert has an outward facing female phone jack which is the functional element. Those skilled in the art will appreciate that numerous other functional elements in addition to those exemplary elements listed above may be incorporated into the insert, the tile, or both without departing from the spirit and scope of the invention.

Other embodiments of the invention will be apparent to those skilled in the art from consideration of the specification and practice of the invention. Furthermore, certain terminology has been used for the purposes of descriptive clarity, and not to limit the present to invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A method of inserting and removing one or more removable inserts within one or more tiles mounted to a surface, comprising the steps of:

installing at least one tile on the surface, the at least one tile including at least two opposing wall portions;

wherein the at least two opposing wall portions at least partially define a perimeter of a receptacle;

wherein installing includes securing a back surface portion of the at least one tile to the surface by at least one means selected from the group consisting of nails, screws, fasteners, glue, mastic, grout and adhesives and applying a building adhesive between a peripheral edge of the at least one tile and a peripheral edge of a second tile; and inserting at least one insert within the receptacle;

wherein the at least one insert has a perimeter that is immediately proximate of and substantially equivalent to the perimeter of the receptacle, and wherein the at least one insert is at least partially secured to the tile by friction between the insert and the tile.

2. The method of claim 1, comprising the further steps of: removing the at least one insert from the receptacle; and inserting a second insert within the receptacle.

3. The method of claim 2, wherein the step of removing the at least one insert comprises: holding the at least one insert by means selected from the group consisting of grasping an outer wall of the at least one insert, applying suction to the outer wall, magnetic attraction between a tool and the at least one insert, grasping a functional element integral with the at least one insert, and using a tool to attach to an exposed element on the surface of the at least one insert; and pull the at least one insert outwardly away from the at least one tile so as to remove the at least one insert from the receptacle.

4. The method of claim 1, wherein the at least one insert forms a net fit to the receptacle perimeter.

5. The method of claim 1, wherein the two opposing wall portions are rigid and further comprising removing the at least one insert by applying a net force on or through an outwardly facing surface of the at least one insert.

6. The method of claim 5, wherein the net force is primarily perpendicular to the outwardly facing surface of the at least one insert.

7. The method of claim 6, wherein the at least one insert forms a net fit to the receptacle perimeter.

8. The method of claim 1, wherein securing includes applying a building adhesive between the surface and the back surface portion of the at least one tile.

9. The method of claim 7, wherein the at least one insert includes two or more inserts collectively having the perimeter that is substantially equivalent to the perimeter of the receptacle.

10. The method of claim 1, wherein the second tile does not define a receptacle.

* * * * *